US005355775A

United States Patent [19]

Wolff

[11] Patent Number: 5,355,775

[45] Date of Patent: Oct. 18, 1994

[54] PRESSURE-TRANSMITTING HYDRAULIC CYLINDER

[75] Inventor: Georg Wolff, Linz, Austria

[73] Assignee: Reisner & Wolff Engineering Gesellschaft m.b.H & Co. KG, Wels, Austria

[21] Appl. No.: 64,113

[22] PCT Filed: Nov. 21, 1991

[86] PCT No.: PCT/AT91/00119

§ 371 Date: May 17, 1993

§ 102(e) Date: May 17, 1993

[87] PCT Pub. No.: WO92/09748

PCT Pub. Date: Jun. 11, 1992

[30] Foreign Application Priority Data

Nov. 21, 1990 [AT] Austria ..... A 2358/90

[51] Int. Cl.[5] ..... F16J 15/18; F16J 9/00

[52] U.S. Cl. ..... 92/168; 92/249

[58] Field of Search ..... 92/248, 249, 250, 254, 92/85 R, 85 B, 93, 91, 92, 168

[56] References Cited

U.S. PATENT DOCUMENTS

| | | | |
|---|---|---|---|
| 2,829,500 | 4/1958 | Butler | 92/92 |
| 3,166,991 | 1/1965 | Blenkle | 92/249 |
| 3,440,930 | 4/1969 | Olson | 92/85 R |
| 3,489,099 | 1/1970 | Huffsmith | 92/248 |
| 3,880,053 | 4/1975 | Trechsel et al. | 92/168 X |

FOREIGN PATENT DOCUMENTS

| | | | |
|---|---|---|---|
| 183208 | 6/1986 | European Pat. Off. . | |
| 2527128 | 12/1976 | Fed. Rep. of Germany . | |
| 3410275 | 10/1985 | Fed. Rep. of Germany . | |
| 2082728 | 3/1982 | United Kingdom | 92/248 |

*Primary Examiner*—Edward K. Look
*Assistant Examiner*—Hoang Nguyen
*Attorney, Agent, or Firm*—Collard & Roe

[57] ABSTRACT

A potlike hydraulic cylinder consists of a cylinder pot (1), a piston (2), which constitutes a cover for the pot, a rubber-elastic plastic body (4), which occupies the pressure space between the cylinder pot (1) and the piston (2) and which forms a closed pocket (6) that is provided with a partition (7), which is substantially parallel to the bottom and constitutes the bottom of the pocket and is connected to at least one bottom extension (8) of the cylinder pot (1), which extension protrudes axially into the plastic body (4), and at least one pressure line (9) for a hydraulic fluid, which pressure line extends through the bottom extension (8) and the partition (7) and opens into the pocket (6). To ensure desirable operating conditions, the partition (7) is adjoined by a peripheral wall (10), which protrudes toward the piston (2).

2 Claims, 2 Drawing Sheets

PRESSURE-TRANSMITTING HYDRAULIC CYLINDER

Figure 1:
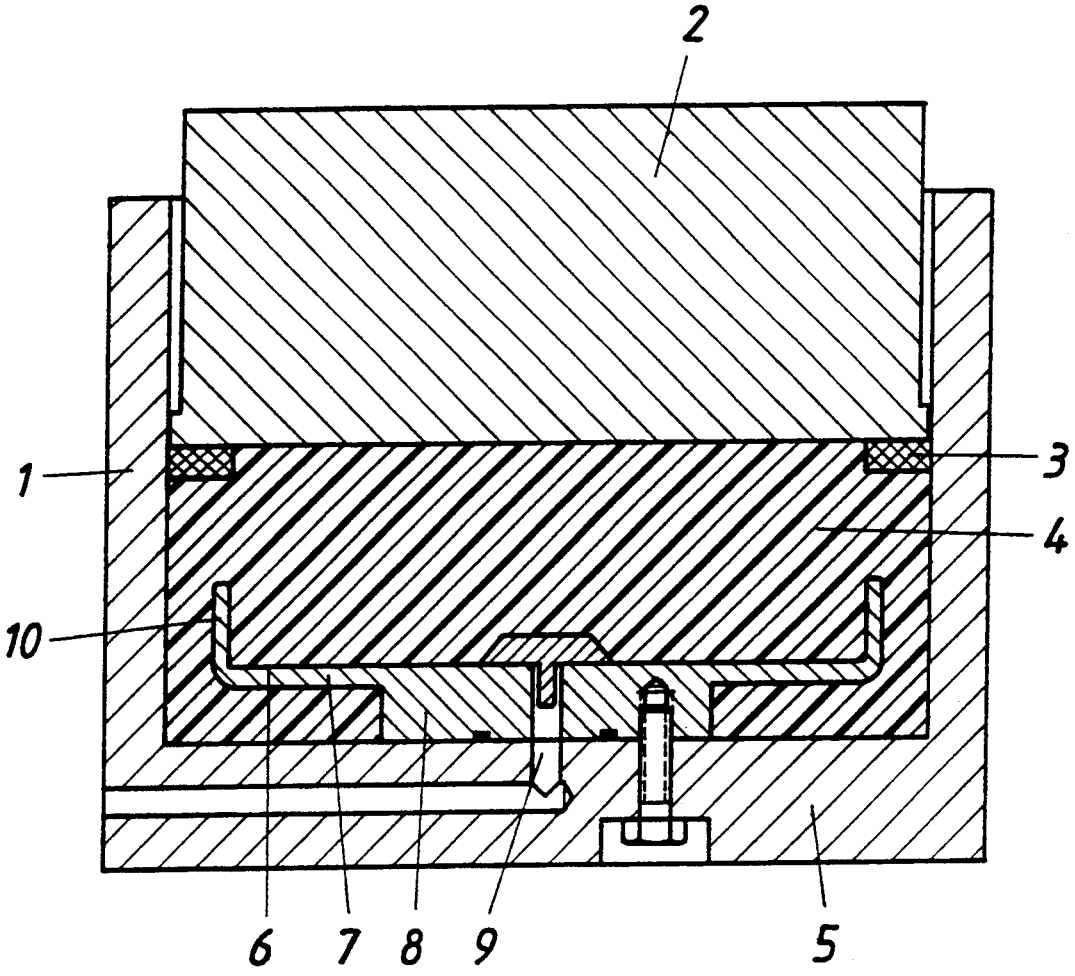

This invention relates to a potlike hydraulic cylinder comprising a cylinder pot, a piston, which constitutes a cover for the pot, a rubber-elastic plastic body, which occupies the pressure space between the cylinder pot and the piston and which forms a closed pocket that is provided with a partition, which is substantially parallel to the bottom and constitutes the bottom of the pocket and is connected to at least one bottom extension of the cylinder pot, which extension protrudes axially into the plastic body, at least one pressure line for a hydraulic fluid, which pressure line extends through the bottom extension and the partition and opens into the pocket.

When conventional hydraulic cylinders are employed to apply or take up strong pressure forces by which the hydraulic cylinder is subjected to a tilting moment, it is necessary to insert expensive pressure-transmitting spherical caps into the hydraulic cylinder in order to relieve it from tilting moments. The seal which is required between the cylinder wall and the piston of the hydraulic cylinder precludes the provision of a substantial guiding gap, which would be necessary to permit a tilting of the piston. Besides, a plastic deformation of the cylinder wall is not permissible even in local regions if the sealing element is not to be endangered. For this reason relatively long pistons are used to take up the lateral forces and substantially increase the overall height. Another requirement to be met by such hydraulic cylinders resides in that they should be made from a material which has a relatively small elastic elongation and a low coefficient of expansion so that the guiding gap between the piston and the cylinder wall cannot be expanded to an extent which would endanger the sealing element under a high load.

In order to avoid said disadvantages it is known from pot-shaped bearings, particularly if they are used in bridges (German Patent Specification 3,410,275), to fill the space between the cylinder pot and the piston, which constitutes a cover for the pot, by a rubber-elastic plastic body, which usually consists of an elastomer and which permits the provision between the pot wall and the piston of a guiding gap which is sufficiently large to permit a tilting of the piston relative to the cylinder pot whereas a sealing of said guiding gap against an extrusion of plastic need not be feared. Such a potlike bearing is supplied with a hydraulic fluid, which is forced into a closed pocket provided within the plastic body so that the latter owing to its incompressibility is displaced against the piston to raise the latter and the pocket is expanded. That pocket is closed at its bottom by a partition, which is joined to a bottom extension of the cylinder pot. Adjacent to the inlet for the hydraulic fluid a pressure line extends thorugh the extension. That partition is intended to permit a hydraulic cushion to be formed under a pressure which is uniformly distributed throughout the surface area of the partition so that the plastic body disposed over the partition will uniformly be raised. But it has been found in practice that under high hydraulic pressures the partition will be pulled out of the pocket of the plastic body or the piston seal will be pulled from the piston because the deformation of the rubber-elastic plastic body cannot be controlled. For this reason the field of application of such potlike bearings is restricted although they are desirable as regards the taking up of tilting moments and lateral forces and are insusceptible to an elongation of materials.

For this reason it is an object of the invention to provide a potlike hydraulic cylinder which is of the kind described first hereinbefore and is so improved by the provision of a simple means that the advantages afforded by the use of a rubber-elastic plastic body can fully be utilized but the disadvantages involved in an uncontrolled deformation of the plastic body will be avoided.

The object set forth is accomplished in accordance with the invention that the partition is adjoined by a peripheral wall, which protrudes toward the piston.

As a result, a guiding gap for the deformation of the plastic body is defined between the pot wall and the peripheral wall which adjoins the partition so that the portion in which the plastic body is essentially deformable is structurally defined. Because the deformation of the rubber-elastic plastic body is thus restricted to a portion of its periphery a pressure applied cannot cause the pocket of the plastic body to be pulled from the partition or an extrusion of a portion of the plastic body between the piston and the piston seal. For this reason the measure adopted in accordance with the invention has the result that the potlike hydraulic cylinder-piston assembly has a high functional reliability and during a draining of the hydraulic fluid from the pocket of the plastic body the piston will return to its initial position without difficulty because the deformation of the plastic body is restricted to a portion of its periphery extending along the pot wall so that the pocket of the plastic body can readily be closed as that portion of the plastic body which is adjacent to the piston descends toward the partition.

It is apparent that the peripheral wall which adjoins the partition constitutes a guiding wall for the deformation of the plastic body. For this reason that wall must have a sufficiently large height, which must be selected in dependence on the conditions in each case. To permit the peripheral wall to perform its guiding functions, an adhering of that wall to the plastic body must be prevented. The wall itself may have any of widely different designs, provided that it is ensured that the wall defines the region in which the plastic body is deformable. A particularly simple design will be obtained if the peripheral wall consists of a raised rim portion of the partition.

Figure 2:
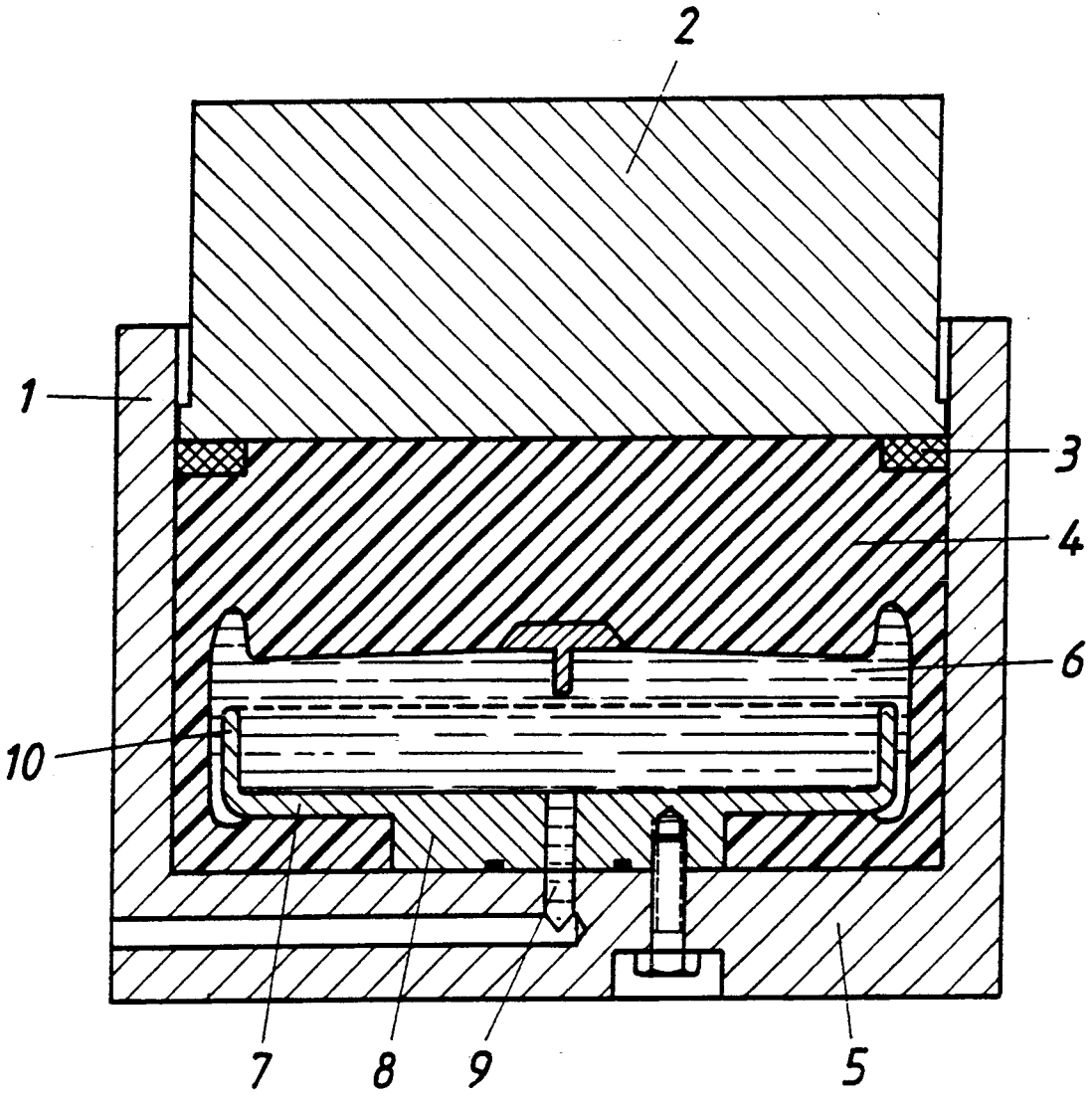

The subject matter of the application is shown by way of example in the drawing, in which FIG. 1 is a schematic axial sectional view showing a potlike hydraulic cylinder in accordance with the invention when it is not being supplied with hydraulic fluid and FIG. 2 is a view which is similar to FIG. 1 and shows the hydraulic cylinder as it is supplied with hydraulic fluid.

The illustrated potlike hydraulic cylinder essentially consists of a cylinder pot 1 and a piston 2, which constitutes a cover for the pot and carries a piston seal 3, which adjoins the wall of the pot. The pressure space defined between the cylinder pot 1 and the piston 2 is occupied by a rubber-elastic plastic body 4, which at a distance from the bottom 5 of the pot forms a pocket 6, which is parallel to the bottom and in which a partition 7, which is parallel to the bottom, is inserted as the bottom of the pocket. That partition 7 is integrally connected to a bottom extension 8, which axially protrudes into the plastic body 4 and through which a pressure line 9 for a hydraulic fluid extends, which line opens into the pocket 6. A difference from known potlike bearings of that kind resides in that the partition 7 is provided with a peripheral wall 10, which adjoins on the outside and which in the illustrative embodiment consists of a raised rim portion of the partition 7. That peripheral wall 10 does not adhere to the plastic body 4 and separates from the remaining plastic body a peripheral portion, which during a supply of hydraulic fluid to the hydraulic cylinder is subjected to the substantial deformation, as is shown in FIG. 2.

The hydraulic fluid which is forced into the pocket 6 then expands the pocket and above the partition 7 constitutes a hydraulic fluid cushion, which is essentially defined by the peripheral wall 10 and by which that portion of the plastic body which is adjacent to the body and, as a result, the piston 2 are raised. As is also apparent from FIG. 2 the restriction of the deformation of the plastic body to a peripheral portion prevents a deformation of the plastic body which would adversely affect the descent of the piston 2 so that the initial position shown in FIG. 1 will be assumed when the hydraulic fluid has been drained.

I claim:

1. Potlike hydraulic cylinder comprising a cylinder pot having a wall and a bottom, a piston constituting a cover for the pot, a rubber-elastic plastic body occupying a pressure chamber between the cylinder pot bottom and the piston, the body forming a closed pocket that is provided with a partition, the partition extending substantially parallel to the pot bottom and constituting a bottom of the pocket, and the partition being connected to at least one bottom extension of the cylinder pot, which extension protrudes axially into the plastic body, and at least one pressure line for a hydraulic fluid, which pressure line extends through the bottom extension and the partition and opens into the pocket to deform the plastic body under hydraulic fluid pressure, and wherein the partition is adjoined by a peripheral wall protruding toward the piston and defining with the pot wall a guiding gap for the deformation of the plastic body.

2. A potlike hydraulic cylinder according to claim 1, characterized in that the peripheral wall consists of a raised rim portion of the partition.

* * * * *